United States Patent [19]

Reinert et al.

[11] 4,155,856

[45] May 22, 1979

[54] PROCESS FOR AFTERTREATING DYED TEXTILE MATERIAL CONTAINING POLYESTER FIBRES

[75] Inventors: Gerhard Reinert, Allschwil, Switzerland; Jean P. Luttringer, Rixheim, France

[73] Assignee: Ciba-Geigy Corporation, Ardsley, N.Y.

[21] Appl. No.: 931,798

[22] Filed: Aug. 7, 1978

[30] Foreign Application Priority Data

Aug. 25, 1977 [CH] Switzerland ..... 10400/77

[51] Int. Cl.[2] ..... D06M 13/20

[52] U.S. Cl. ..... 252/8.9; 8/137; 8/137.5; 8/139.1; 8/73

[58] Field of Search ..... 252/8.9, 171; 8/73, 8/169, 137, 137.5, 139.1

[56] References Cited

U.S. PATENT DOCUMENTS

| | | | |
|---|---|---|---|
| 3,679,349 | 7/1972 | Eltz et al. | 8/137.5 |
| 3,684,431 | 8/1972 | Bischof et al. | 8/137 |
| 3,701,627 | 10/1972 | Grunewalder | 8/139.1 |

FOREIGN PATENT DOCUMENTS

| | | |
|---|---|---|
| 808967 | 2/1959 | United Kingdom. |
| 1497110 | 1/1978 | United Kingdom. |

*Primary Examiner*—William E. Schulz

*Attorney, Agent, or Firm*—Edward McC. Roberts

[57] ABSTRACT

A process for aftertreating dyed textile material consisting of or containing polyester fibres and thus preventing oligomer deposits on the dyeings, which process comprises treating said textile material at a temperature below the glass transition point of the polyester fibres with an aqueous emulsion of an oligomer-dissolving substance which consists of (a) an ester of an aliphatic or aromatic carboxylic acid with an aliphatic or araliphatic monoalcohol containing 1 to 10 carbon atoms, (b) an aliphatic or aromatic halogenated hydrocarbon, (c) a non-ionic adduct of not more than 10 moles of alkylene oxide with alcohols, fatty acids or amines, each containing 8 to 22 carbon atoms, or with phenols which can be substituted by alkyl or phenyl, the cloud point of said adduct being below the application temperature, or (d) a polyethylene oxide/polypropylene oxide block polymer, the hydrophobic polyoxypropylene moiety of which has a molecular weight of 800 to 4000, and the hydrophilic moiety of the entire molecule is from 10 to 35% by weight, the cloud point of said block polymer being below the application temperature, or which consists of a mixture of said substances (a), (b), (c) and (d).

17 Claims, No Drawings

PROCESS FOR AFTERTREATING DYED TEXTILE MATERIAL CONTAINING POLYESTER FIBRES

The present invention relates to a process for aftertreating dyed textile material containing polyester fibres, and to the textile material aftertreated by this process.

It is known that, when dyeing polyester material, especially under high temperature conditions, an oligomer deposit forms. This deposit on the surface of the material can result not only in a poor appearance of the goods (filter effect, blotchy dyeings), but also in complications in spinning, winding off and knitting. These oligomers are formed during the manufacture of the polyester fibres, and, under dyeing conditions, find their way into the dyebath where they crystallise out on the material to be dyed and/or in the dyeing machines and lead to the deposits referred to above. There is an increased tendency for oligomer deposits to form whenever polyester material is cleansed beforehand in an organic solvent, especially in perchloroethylene, and afterwards subjected to an aqueous high temperature dyeing process.

The formation of oligomer deposits is also increased by the addition of carriers during dyeing.

Efforts are therefore being made to prevent this undesirable deposit of oligomers on the material either during the dyeing procedure or before the further processing of the textile material.

It is known from German Offenlegungsschrift No. 2,403,859 that the formation of oligomer deposits can be prevented by adding to the dyebath emulsions of phthalic acid diesters of aliphatic or araliphatic alcohols containing 6 to 20 carbon atoms when dyeing at temperatures above 130° C.

However, in most cases oligomer formation is usually only insufficiently prevented.

Furthermore, it has been proposed to remove oligomer deposits occurring on the goods after they have been dyed by means of rinsing procedures, for example by effecting a washing-off with organic solvents or solvent mixtures, especially with perchloroethylene. Such a procedure, however, incurs the disadvantage of heavy expense on account of the large amounts of solvent to be recovered.

It has now been found that the problems caused by the formation of oligomer deposits can surprisingly be solved in a very simple manner by subjecting the dyed textile material to an aftertreatment with an aqueous emulsion of a suitable oligomer-dissolving substance at a temperature below the glass transition point of the polyester fibres (depending on the type of polyester, at 75° to 85° C.).

Accordingly, the present invention provides a process for aftertreating dyed textile material which contains polyester fibres, which comprises treating said textile material at a temperature below the glass transition point of the polyester fibres with an aqueous emulsion of an oligomer-dissolving substance which consists of (a) an ester of an aliphatic or aromatic carboxylic acid with an aliphatic or araliphatic monoalcohol containing 1 to 10 carbon atoms, especially with an alkanol containing 1 to 10 carbon atoms, (b) an aliphatic or aromatic halogenated hydrocarbon, (c) a non-ionic adduct of not more than 10 moles of alkylene oxide with alcohols, fatty acids or amines, each containing 8 to 22 carbon atoms, or with phenols which can be substituted by alkyl or phenyl, the cloud point of said adduct being below the application temperature, or (d) a polyethylene oxide/polypropylene oxide block polymer, the hydrophobic polyoxypropylene moiety of which has a molecular weight of 800 to 4000, and the hydrophilic moiety of the entire molecule is from 10 to 35% by weight, the cloud point of said block polymer being below the application temperature, or which consists of a mixture of said substances (a), (b), (c) and (d).

Compared with the known processes, the process of the present invention possesses unexpected advantages. By using the above oligomer-dissolving substances in the form of an emulsion, a substantially smaller amount of these substances is required than when effecting a washing-off with these compounds in pure form and at the same time the oligomers are equally well removed. Surprisingly, it is also evident that the oligomers dissolve very much better if the treatment is carried out at a temperature below the glass transition point than if the same oligomer-dissolving substances are added under dyeing conditions, i.e. above the glass transition point. In addition, there is no danger that the dye present in the fibre will be dissolved out again.

The aqueous emulsion preferably contains 0.1 to 10% by weight, in particular 1 to 5% by weight, of the oligomer-dissolving substance, based on the weight of the textile material.

In addition to having good solubility for the oligomers, the compounds used according to the invention as oligomer-dissolving substances have a very limited solubility in water and can be easily converted into an aqueous emulsion under the treatment conditions, if necessary with the aid of emulsifiers.

Preferably the above esters (a) are used, for example esters of acetic acid, propionic acid, adipic acid, sebacic acid, benzoic acid or phthalic acid, the ester component preferably being derived from alkanols containing 1 to 10 carbon atoms. Particularly suitable esters are: 2-ethylhexyl acetate, benzyl acetate, phenyl acetate, ethyl salicylate, methyl, ethyl or propyl benzoate, dimethyl or diethyl phthalate. The preferred esters are those of aromatic carboxylic acids, especially of benzoic acid or phthalic acid, with alkanols containing 1 to 4 carbon atoms, for example with methanol, ethanol, propanol or butanol.

Suitable aliphatic or aromatic halogenated hydrocarbons (b) are preferably fluorinated, brominated or chlorinated hydrocarbons, for example chlorinated ethylenes or chlorobenzenes. Trichloroethylene and, in particular, tetrachloroethylene, as well as mono-, di- and trichlorobenzene, are preferred.

Suitable non-ionic adducts (c) are preferably reaction products of 1 to 20, preferably 5 to 15, moles of alkylene oxide, for example propylene oxide and/or preferably ethylene oxide, with an aliphatic monoalcohol or a fatty acid, each containing 8 to 18 carbon atoms, or with an alkyl phenol containing 4 to 12 carbon atoms in the alkyl moiety. Preferred adducts (c) are reaction products of 5 to 15 moles of ethylene oxide and 1 mole of a fatty acid containing 12 to 18 carbon atoms or an alkyl phenol containing 5 to 15 carbon atoms in the alkyl moiety.

Particularly preferred representatives of these alkylene oxide reaction products are adducts of 5 to 10 moles of ethylene oxide with p-nonyl phenol or, especially, p-tert-octyl phenol, as well as with stearic acid.

Suitable oligomer-dissolving substances (d) are block polymers of the formula $$HO(CH_2CH_2O)_x(\underset{\underset{CH_3}{|}}{CH}-CH_2-O)_y(CH_2CH_2O)_z H$$

wherein the molecular weight of the polyoxypropylene moiety y is between 1000 and 4000, preferably between 2000 and 4000 and x and z comprise 10 to 35% of the entire molecule.

Both the adducts (c) and the block polymers (d) should have a cloud point which is below the application temperature. Preferably, the cloud point of these substances is in the range from 10° to 60° C. The cloud point is determined for example according to DIN 53 917.

The oligomer-dissolving substances can be used individually or as a mixture of two or more of the substances (a), (b), (c) and (d). They must be in the form of an emulsion under the treatment conditions. If the oligomer-dissolving substances do not form an emulsion with water, they are used together with emulsifiers. Suitable emulsifiers are the known, preferably synthetic, emulsifiers. They are anionic, cationic, ampholytic or non-ionic compounds. If these emulsifiers have a cloud point, then this latter is above the application temperature. Preferred emulsifiers are anionic. Examples of anionic emulsifiers are the salts, for example alkali metal salts or ammonium salts, of fatty acids containing 8 to 18 carbon atoms, of sulphuric acid esters, for example sodium laurylsulphate or the sodium salt of sulphosuccinic acid dialkyl esters, as well as of sulphuric acid esters or phosphoric acid esters of ethoxylated fatty alcohols or alkyl phenols and also Turkey red oil. It is also possible to use salts of sulphonic acids, for example arylsulphonates or alkylarylsulphonates and fatty acid adducts of different hydrophilic groups, for example protein condensation products or phosphates.

Suitable cationic emulsifiers are in particular fatty amines, quaternary ammonium compounds, for example trimethylcetylammonium chloride or quaternary compounds of pyridine, morpholine or imidazoline, for example laurylpyridinium chloride. Suitable ampholytic emulsifiers are especially long-chain substituted amino acids or betaines.

Non-ionic emulsifiers are for example lecithins, steroids, fatty acid amides, partial esters of polyalcohols, for example glycerol mono- or distearates and glycerol mono- and dioleates, especially however adducts of ethylene or propylene oxide with fatty acids, fatty alcohols, fatty amines, partial fatty acid esters of polyhydric alcohols, alkyl phenols or also polyalkylene glycols, the cloud points of which are above the application temperature.

The emulsifiers are employed in amounts of 5 to 100% by weight, based on the oligomer-dissolving substance. The treatment baths can contain further ingredients, for example acids, bases or salts.

Not only oligomers, but also residues of disperse dyes, carrier etc., are removed from the surface of the material by the process of the present invention. This is advantageous chiefly when dyeing fibre blends, because the fastness to rubbing and wet fastness properties are thereby improved.

Suitable polyester fibrous material is in particular textile material made from linear high molecular polyesters which are obtained, for example, by polycondensation of aromatic polycarboxylic acids with polyfunctional alcohols, especially polyesters derived from terephthalic acid or dimethylol cyclohexane or copolymers of terephthalic acid and isophthalic acid with ethylene glycol. Polyethylene terephthalate fibres are preferred. The textile materials can also be used as blends with one another or with other fibres, for example blends of polyacrylonitrile/polyester, polyamide/polyester, polyester/viscose and polyester/wool.

The textile material can be in the most widely different stages of processing, for example in the form of piece goods, such as wovens and knits, of nonwovens, yarn, flocks, spinning cable or tops.

The aftertreatment of the polyester material is normally carried out subsequent to a dyeing which has preferably been effected with disperse dyes under high temperature conditions, for example at 110°–140° C. The dyeing is advantageously carried out by the exhaust method, preferably in closed dyeing machines, for example in circulation dyeing machines, such as cheese or beam dyeing machines, jet machines, winch becks, paddles, jiggers or rotary type dyeing and washing machines. The liquor ratio (ratio of the amount of goods in kg to the amount of treatment liquor in liters) is preferably chosen in the range from 1:3 to 1:50, in particular form 1:6 to 1:20.

The treatment temperature is normally below the glass transition point of the polyester fibres in the emulsion employed. Preferably, the treatment is carried out at a temperature from 30° to 85° C., in particular from 40° to 70° C. The length of the treatment depends on the degree of the oligomer deposit, the textile material and the treatment conditions, such as temperature, amount and composition of the emulsion. In general, the treatment time is between 5 and 45 minutes.

The aftertreatment can advantageously be carried out concurrently with other operations. For example, the oligomer-dissolving substance (a), (b), (c) and/or (d) can be added to the alkaline bath in which the dyed polyester material is subjected to a reduction after-clear with sodium hydrogen sulphite, such that the reduction after-clear and the treatment with the oligomer inhibitor is carried out in a single operation.

The process of the present invention yields a textile material which is virtually free from oligomer deposits.

The polyester yarns treated by the process of the invention can accordingly be better twisted. Furthermore, the number of filament ruptures is reduced, so that the capacity of the twisting machine is substantially increased. In addition, marked advantages are observed when winding off and spinning, for example polyester tow, as the deleterious abrasion is largely avoided.

In the following Examples the parts and percentages are by weight.

EXAMPLE 1

A. Dyeing 25 g of texturised polyester knitted fabric are wound onto a perforated spool and dyed in a multi-colour pressure dyeing machine in a liquor ratio of 1:12 as follows:

1 g of the dyestuff mixture of the formulae

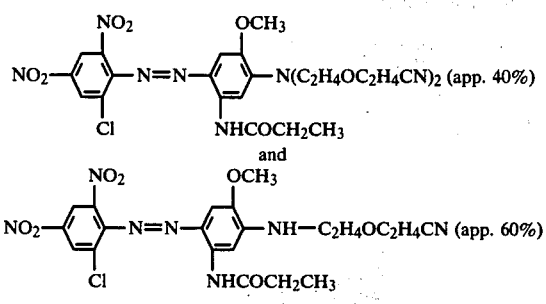

in commercially available form and containing about 73% of dispersant, is dispersed in 300 ml of desalinated water of 50° C. Then 1.2 g of a diphenyl carrier (containing 84% by weight of diphenyl) are also dispersed therein and the pH of the bath is adjusted to 5 with formic acid. Dyeing is initially carried out with this bath for 5 minutes at 50° C. The bath is then heated to 130° C. in the course of 30 minutes and this temperature is kept for 60 minutes. The bath is subsequently cooled to 90° C. and run off. The goods are rinsed twice with warm water of 50° C. and finally dried. A navy blue dyeing is obtained with very distinct white oligomer deposits in the innermost layers of the wound knitted fabric.

B. Aftertreatment

The dyed knitted fabric is afterwards treated in a liquor ratio of 1:10 for 30 minutes at 50° C. with an aqueous emulsion which contains per liter: 2 g of sodium dithionite (hydrosulphite), 2.5 ml of sodium hydroxide solution of 36° Bé, and 4 g of a mixture of 90% of ethyl benzoate and 10% of an ammonium salt of the acid phosphoric acid ester of the adduct of 9.7 moles of ethylene oxide with 1 mole of 4-nonyl phenol.

The fabric is then rinsed firstly with water of 40° C. which contains, per liter, 1 ml of 80% acetic acid, then neutralised and again rinsed with water, and finally dried in a warm flow of air at 60° C. No more oligomers can be detected on the knitted fabric after this treatment.

C. Comparison Test

The knitted fabric dyed in accordance with (A) is subjected to an aftertreatment exactly as described in (B) in a liquor of the same composition but which does not contain the mixture of ethyl benzoate and the anionic ethylene oxide adduct. No reduction in the oligomers which have precipitated onto the fabric can be detected.

EXAMPLE 2

A. Dyeing 100 g of a polyester yarn in muff form are dyed in a circulating dyeing machine with a dye liquor which is prepared as follows:

1 g of ammonium sulphate is dissolved in 1000 ml of water of 50° C. and 4 g of a self-emulsifying diphenyl carrier and 4 g of the dyestuff mixture of Example 1 (A) are dispersed in this solution with an impeller. The pH of the bath is then adjusted to 5 with formic acid. The polyester yarn is treated in this dyebath initially for 10 minutes at 50° C. and a circulation rate of about 20 l/kg, then the temperature is raised to 130° in the course of 30 minutes and the yarn is dyed for 60 minutes. The dyebath is subsequently cooled to about 90° C., run off, and the dyed goods are rinsed with water of 40° C.

B. Aftertreatment

The dyed yarn is afterwards treated for 20 minutes at 70° C. with 1000 ml of an aqueous emulsion which contains 5 ml of sodium hydroxide solution of 36° Bé, 3 g of sodium dithionite, 1 g of the adduct of 17.5 moles of ethylene oxide with stearyl diethylene triamine and 5 g of a mixture of 80% of tetrachloroethylene and 20% of an ammonium salt of the acid phosphoric acid ester of the adduct of 9.7 moles of ethylene oxide with 1 mole of 4-nonyl phenol.

The goods are rinsed twice, the first rinsing bath containing 2 ml/l of 80% acetic acid for neutralising the goods. The yarn is centrifuged and finally dried in a forced draught oven at 100° C.

C. Test of oligomer abrasion

The amount of oligomers present on the surface of the fibres—deposited oligomers—is determined by drawing 500 m of non-treated and treated yarn through a slit in stiff, black cardboard while winding off. The oligomers deposited on the surface of the yarn are scraped off and evaluated visually. The yarn subjected to the above described aftertreatment has only a faint white mark of abraded oligomers, whereas the non-treated yarn exhibits a high degree of oligomer abrasion.

D. Comparison Test

The yarn dyed according to (A) is subjected to an aftertreatment exactly as described in B in a liquor of the same composition but which does not contain the mixture of tetrachloroethylene and the anionic ethylene oxide adduct. The mark left by abraded oligomers is 5 times as large.

EXAMPLES 3 TO 12

The knitted fabric dyed according to Example 1 (A) is subjected to an aftertreatment exactly as described in Example 1 (B) with an emulsion of the same composition but containing the mixtures listed in column 2 of Table 1 in the amounts indicated in column 3, instead of the mixture of ethyl benzoate and ethylene oxide adduct. No more oligomers can be detected on the fabric after this aftertreatment.

Table 1

| Example | Mixture of oligomer-dissolving substance and emulsifier | Amount (in g) |
|---|---|---|
| 3 | 1 part of ethyl benzoate and 1 part of the anionic ethylene oxide adduct of Example 1 B | 5 |
| 4 | 4 parts of ethyl benzoate and 0.5 part of the anionic ethylene oxide adduct of Example 1 B | 2 |
| 5 | 4 parts of methyl benzoate and 1 part of the anionic ethylene oxide adduct of Example 1 B | 3 |
| 6 | 4 parts of propyl benzoate and 1 part of the anionic ethylene oxide adduct of Example 1 B | 4 |
| 7 | 4 parts of diethyl phthalate and 1 part of the anionic ethylene oxide adduct of Example 1 B | 4 |
| 8 | 4 parts of benzyl acetate and 1 part of the ethylene oxide adduct of Example 1 B | 4 |
| 9 | 4 parts of 1,2,4-trichlorobenzene and 1 part of the anionic ethylene oxide adduct of Example 1 B | 4 |
| 10 | 4 parts of propyl benzoate and 1 part of | 4 |

Table 1-continued

| Example | Mixture of oligomer-dissolving substance and emulsifier | Amount (in g) |
|---|---|---|
| | the adduct of 8.2 moles of ethylene oxide with 1 mole of p-tert-octyl phenol | |
| 11 | 4 parts of dimethyl sebacate and 1 part of the ethylene oxide adduct of Example 10 | 4 |
| 12 | 4 parts of diethyl adipate and 1 part of the ethylene oxide adduct of Example 10 | 4 |

EXAMPLE 13 TO 15

The yarn dyed according to Example 2 (A) is subjected to an aftertreatment exactly as described in Example 2 (B) in a liquor of the same composition but containing the mixtures listed in column 2 of Table 2 in the amounts indicated in column 3, instead of the mixture of tetrachloroethylene and the anionic ethylene oxide adduct. The test of Example 2 (C) shows only a very slight oligomer abrasion, which is distinctly less significant than on yarn which has been dyed and aftertreated in the same manner, except that no oligomer-dissolving substances were used in the after-treatment liquor.

TABLE 2

| Example | Mixture of oligomer-dissolving substance and emulsifier | Amount (in g) |
|---|---|---|
| 13 | 1 part of diethyl phthalate and 1 part of the anionic ethylene oxide adduct of Example 1 B | 2.5 |
| 14 | 9 parts of diethyl phthalate and 1 part of the ethylene oxide adduct of Example 10 | 2.5 |
| 15 | 9 parts of methyl benzoate and 1 part of the ethylene oxide adduct of Example 10 | 2.5 |

EXAMPLES 16 TO 21

A. Dyeing 30 g of a polyester yarn in muff form are dyed in a multi-colour pressure dyeing machine with several dyeing areas in a liquor ratio of 1:10 as follows:

1 g of the dyestuff mixture of Example 1 (A) are dispersed in 300 ml of water with the addition of 0.2 g of an anionic dispersant, 0.6 g of ammonium sulphate and 0.6 g of a diphenyl carrier (containing 84% by weight of diphenyl) and the pH of the dyebath is adjusted to 5 with formic acid. The goods are then put into the dyebath at 60° C. and this temperature is kept for 10 minutes. The dyebath is heated to 130° C. in the course of 30 minutes and the goods are dyed for 90 minutes at this temperature. Finally the bath is cooled to 80° C. and run off. The yarn is rinsed twice with water of 50° C. and dried. A navy blue dyeing with distinct oligomer deposits is obtained.

B. Aftertreatment

The dyed yarn is subsequently treated in a liquor ratio of 1:10 for 30 minutes at 80° C. with an aqueous liquor which contains in each case the components indicated in Table 3.

After the treatment, the liquor is run off at 80° C., then the goods are rinsed for 5 minutes at 60° C. and thereafter treated with a rinsing bath which contains 2 ml/l of 80% acetic acid. Finally, the yarn is dried at 110° C. and tested for oligomer abrasion as in Example 2 (C).

The results are reported in Table 3.

Table 3

| Example | Components of the aftertreatment bath | Result of the abrasion test |
|---|---|---|
| 16 | 2.5 g of a mixture of 90 parts of a block polymer with a mol. wt. of 3250, a 10% hydrophilic moiety and a cloud point of 15° C., and 10 parts of the ethylene adduct of Example 1 B | trace of abrasion |
| 17 | 5 ml/l of sodium hydroxide solution of 36° Be, 3 g/l of sodium dithionite, 2.5 g/l of the mixture of Example 16 | no abrasion |
| 18 | 2.5 g/l of a mixture of 90 parts of block polymer with a mol.wt. of 4000, a 10% hydrophilic moiety and a cloud point of 14° C., and 10 parts of a mixture of lauryl alcohol triglycol ether and coconut fatty acid N,N-di-2-hydroxyethylamine (1:1) | no abrasion |
| 19 | 5 ml/l of sodium hydroxide solution of 36° Be, 3 g/l of sodium dithionite, 2.5 g/l of the mixture of Example 18 | trace of abrasion |
| 20 | 2.5 g/l of a mixture of 90 parts of an adduct of 5 moles of ethylene oxide with stearic acid, 10 parts of a mixture of lauryl alcohol triglycol ether and coconut fatty acid N,N-di-β-hydroxyethylamine (1:1) | no abrasion |
| 21 | 3.5 g/l of a mixture of 50 parts of the block polymer of Example 18, 40 parts of diethyl phthalate and 10 parts of the sodium salt of dioctyl sulphosuccinate | trace of abrasion |

EXAMPLE 22

The knitted fabric dyed according to Example 1 (A) with a visible oligomer deposit is subjected to an aftertreatment for 30 minutes at 60° C. and in a liquor ratio of 1:20 with an aqueous emulsion which contains 2.5 g/l of a mixture of 90 parts of methyl benzoate and 10 parts of an ammonium salt of the acid phosphoric acid ester of the adduct of 9.7 moles of ethylene oxide with 1 mole of 4-nonyl phenol.

The goods are afterwards washed twice with water. No more visible oligomers are detected after this treatment.

A knitted fabric without visible oligomers is also obtained by repeating the procedure of this Example, but using 2.5 g/l of a mixture of 90 parts of diethyl phthalate and 10 parts of the sodium salt of dioctyl sulphosuccinate instead of the mixture employed above.

We claim:

1. A process for preventing oligomer deposits on dyeings produced on textile material consisting of or containing polyester fibres, which process comprises treating said textile material at a temperature below the glass transition point of the polyester fibres, after the dyeing procedure, with an aqueous emulsion of an oligomer-dissolving substance which consists of (a) an ester of an aliphatic or aromatic carboxylic acid with an aliphatic or araliphatic monoalcohol containing 1 to 10 carbon atoms, (b) an aliphatic or aromatic halogenated hydrocarbon, (c) a non-ionic adduct of not more than 10 moles of alkylene oxide with alcohols, fatty acids or amines, each containing 8 to 22 carbon atoms, or with phenols which can be substituted by alkyl or phenyl, the cloud point of said adduct being below the application temperature, or (d) a polyethylene oxide/polypropylene oxide block polymer, the hydrophobic polyoxypropylene moiety of which has a molecular weight of 800 to 4000, and the hydrophilic moiety of the entire molecule is from 10 to 35% by weight, the cloud point of said block polymer being below the application temperature, or which consists of a mixture of said substances (a), (b), (c) and (d).

2. A process according to claim 1, wherein the after-treatment is carried out at a temperature of 30° to 80° C.

3. A process according to claim 2, wherein the after-treatment is carried out at a temperature of 40° to 70° C.

4. A process according to claim 1, wherein the aqueous emulsion contains 0.1 to 10% by weight, of the oligomer-dissolving substance, based on the weight of the textile material.

5. A process according to claim 4, wherein the aqueous emulsion contains 1 to 5% by weight of the oligomer-dissolving substance, based on the weight of the textile material.

6. A process according to claim 1, wherein the after-treatment is carried out while simultaneously subjecting the dyed polyester fibres to a reduction after-clear.

7. A process according to claim 1, wherein said dyeings are produced with disperse dyes under high temperature conditions by the exhaust method.

8. A process according to claim 1, wherein the oligomer-dissolving substance (a) is an ester of an aliphatic or aromatic, monovalent or polyvalent carboxylic acid with an aliphatic or araliphatic monoalcohol containing not more than 10 carbon atoms.

9. A process according to claim 7, wherein the oligomer-dissolving substance (a) is an ester of an aliphatic or aromatic monovalent or polyvalent carboxylic acid with an alkanol containing 1 to 10 carbon atoms.

10. A process according to claim 9, wherein the oligomer-dissolving substance (a) is an ester of benzoic acid or phthalic acid with an alkanol containing 1 to 4 carbon atoms.

11. A process according to claim 1, wherein the oligomer-dissolving substance (b) is trichloroethylene, tetrachloroethylene or trichlorobenzene.

12. A process according to claim 1, wherein the oligomer-dissolving substance (c) is an adduct of 5 to 15 moles of ethylene oxide with an aliphatic monoalcohol or a fatty acid, each containing from 8 to 18 carbon atoms, or an alkylphenol containing 4 to 12 carbon atoms in the alkyl moiety, said adduct having a cloud point in the range from 10° to 60° C.

13. A process according to claim 12, wherein the oligomer-dissolving substance (c) is an adduct of 5 to 15 moles of ethylene oxide with 1 mole of a fatty acid containing 12 to 18 carbon atoms or with an alkylphenol containing 4 to 12 carbon atoms in the alkyl moiety.

14. A process according to claim 1, wherein the oligomer-dissolving substance (d) is a block polymer of the formula $$HO(CH_2CH_2O)_x(\underset{\underset{CH_3}{|}}{CH}-CH_2-O)_y(CH_2CH_2O)_z-H$$

wherein the polyoxypropylene moiety y has a molecular weight of 1000 to 4000 and x and z together comprise 10 to 35% by weight of the entire molecule.

15. A process according to claim 1, wherein the oligomer-dissolving substance is a mixture of two or more of said substances (a), (b), (c) and (d).

16. A process according to claim 1, wherein the emulsion contains an anionic emulsifier.

17. An aqueous emulsion of an oligomer-dissolving substance consisting of (a) an ester of an aliphatic or aromatic carboxylic acid with an aliphatic or araliphatic monoalcohol containing 1 to 10 carbon atoms, (b) an aliphatic or aromatic halogenated hydrocarbon, (c) a non-ionic adduct of not more than 10 moles of alkylene oxide with alcohols, fatty acids or amines, each containing 8 to 22 carbon atoms, or with phenols which can be substituted by alkyl or phenyl, the cloud point of said adduct being below the application temperature, or (d) a polyethylene oxide/polypropylene oxide block polymer, the hydrophobic polyoxypropylene moiety of which has a molecular weight of 800 to 4000, or consisting of a mixture of said substances (a), (b), (c) and (d), for carrying out the process according to claim 1.

* * * * *